US011946649B2

(12) United States Patent
Todd et al.

(10) Patent No.: US 11,946,649 B2
(45) Date of Patent: Apr. 2, 2024

(54) ARTICULATING MECHANISM FOR AN APPLIANCE

(71) Applicant: Haier US Appliance Solutions, Inc., Wilmington, DE (US)

(72) Inventors: Justin Patrick Todd, Louisville, KY (US); Cristopher Lopez Regalado, Queretaro (MX); Luis Enrique Salas Rico, Santiago de Queretaro (MX)

(73) Assignee: Haier US Appliance Solutions, Inc., Wilmington, DE (US)

( * ) Notice: Subject to any disclaimer, the term of this patent is extended or adjusted under 35 U.S.C. 154(b) by 171 days.

(21) Appl. No.: 17/339,076

(22) Filed: Jun. 4, 2021

(65) Prior Publication Data

US 2022/0390122 A1 Dec. 8, 2022

(51) Int. Cl.
*F24C 15/08* (2006.01)
*F24C 7/08* (2006.01)

(52) U.S. Cl.
CPC ..... *F24C 15/08* (2013.01); *F24C 7/082* (2013.01)

(58) Field of Classification Search
CPC ..... F24C 15/08; F24C 7/082; F24C 3/124
USPC ..... 126/1 R
See application file for complete search history.

(56) References Cited

U.S. PATENT DOCUMENTS 9,207,712 B1 * 12/2015 McAlpine ..... G06F 1/162
10,429,885 B1 * 10/2019 Shaw ..... G06F 1/166
2010/0301034 A1 * 12/2010 Greenwood ..... F24C 7/006 219/400
2015/0185788 A1 * 7/2015 Matsuoka ..... E05D 3/06 16/221
2016/0320067 A1 11/2016 Dachs
2018/0187897 A1 * 7/2018 Kim ..... F24C 7/085
2021/0010676 A1 * 1/2021 Davison ..... F24C 3/126
2022/0128241 A1 * 4/2022 Koether ..... F24C 7/082

FOREIGN PATENT DOCUMENTS

CN 207050006 U 2/2018
CN 110207229 A * 9/2019 ..... F24C 15/20
CN 110207229 A 9/2019
CN 209377312 U 9/2019
DE 102015106243 A1 10/2016

* cited by examiner

*Primary Examiner* — Allen R. B. Schult
*Assistant Examiner* — William C Weinert
(74) *Attorney, Agent, or Firm* — Dority & Manning, P.A.

(57) ABSTRACT

A cooking appliance extending along a lateral direction between a pair of opposing sides, extending along a transverse direction between a front and a back, and extending along a vertical direction between a top and a bottom, includes a front panel supported by the cooking appliance, the front panel defining an opening; a user interface panel rotatably positioned at the opening, the user interface panel being rotatable between a first position and a second position; and a rotatable support mechanism that carries the user interface panel between the first position and the second position, the rotatable support mechanism positioned proximate to the opening and having an axis of rotation that is spaced apart from the opening and located above and in front of the user interface panel when in the first position.

18 Claims, 4 Drawing Sheets

ARTICULATING MECHANISM FOR AN APPLIANCE

FIELD OF THE INVENTION

The present subject matter relates generally to home appliances, and more particularly to articulating panels for home appliances such as oven ranges.

BACKGROUND OF THE INVENTION

Conventional appliances such as oven ranges contain a litany of controls and functions which operate to cook or heat items such as food. These conventional appliances typically include user interfaces that allow users to manipulate these controls. Recently, appliances have begun incorporating flat panel type user interfaces, such as touch screens and the like. The location of the user interface on the appliance may vary according to specific embodiments. For instance, many conventional appliances include a user interface panel on a front face of the appliance.

However, the user interface panels on conventional range appliances are typically located at a waist-level of an average user. In this case, when the user interface panel is a flat panel (e.g., touch screen), a usability and visibility of the user interface panel may be affected negatively. For instance, the user interface panel may be oriented in a vertical direction, which is not a conducive viewing angle for the average user. Similarly, a perfectly vertical user interface panel may be difficult to operate for the average user. Additionally or alternatively, some conventional oven ranges incorporate a bullnose or extension extending from the top of the oven range toward the user. When the user interface panel is provided below this extension, it is difficult to see or operate the user interface panel.

Accordingly, an articulating user interface panel incorporating features that obviate one or more of the above-mentioned drawbacks would be beneficial. In particular, an appliance having an articulating user interface panel that is more easily viewable and operatable would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a cooking appliance is provided. The cooking appliance may extend along a lateral direction between a pair of opposing sides, extend along a transverse direction between a front and a back, and extend along a vertical direction between a top and a bottom. The cooking appliance may include a front panel supported by the cooking appliance, the front panel defining an opening; a user interface panel rotatably positioned at the opening, the user interface panel being rotatable between a first position and a second position; and a rotatable support mechanism that carries the user interface panel between the first position and the second position, the rotatable support mechanism positioned proximate to the opening and having an axis of rotation that is spaced apart from the opening and located above and in front of the user interface panel when in the first position.

In another exemplary aspect of the present disclosure, an articulating display assembly is disclosed. The articulating display may define a vertical direction, a lateral direction, and a transverse direction. The articulating display assembly may include a frame defining an opening along the transverse direction; a support housing rotatably connected to the frame, the support housing being rotatable between a closed position and an open position; and a user interface panel attached to the support housing, wherein the support housing is positioned proximate to the opening and having an axis of rotation that is spaced apart from the opening and located above and in front of the user interface panel when the support housing is in the closed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
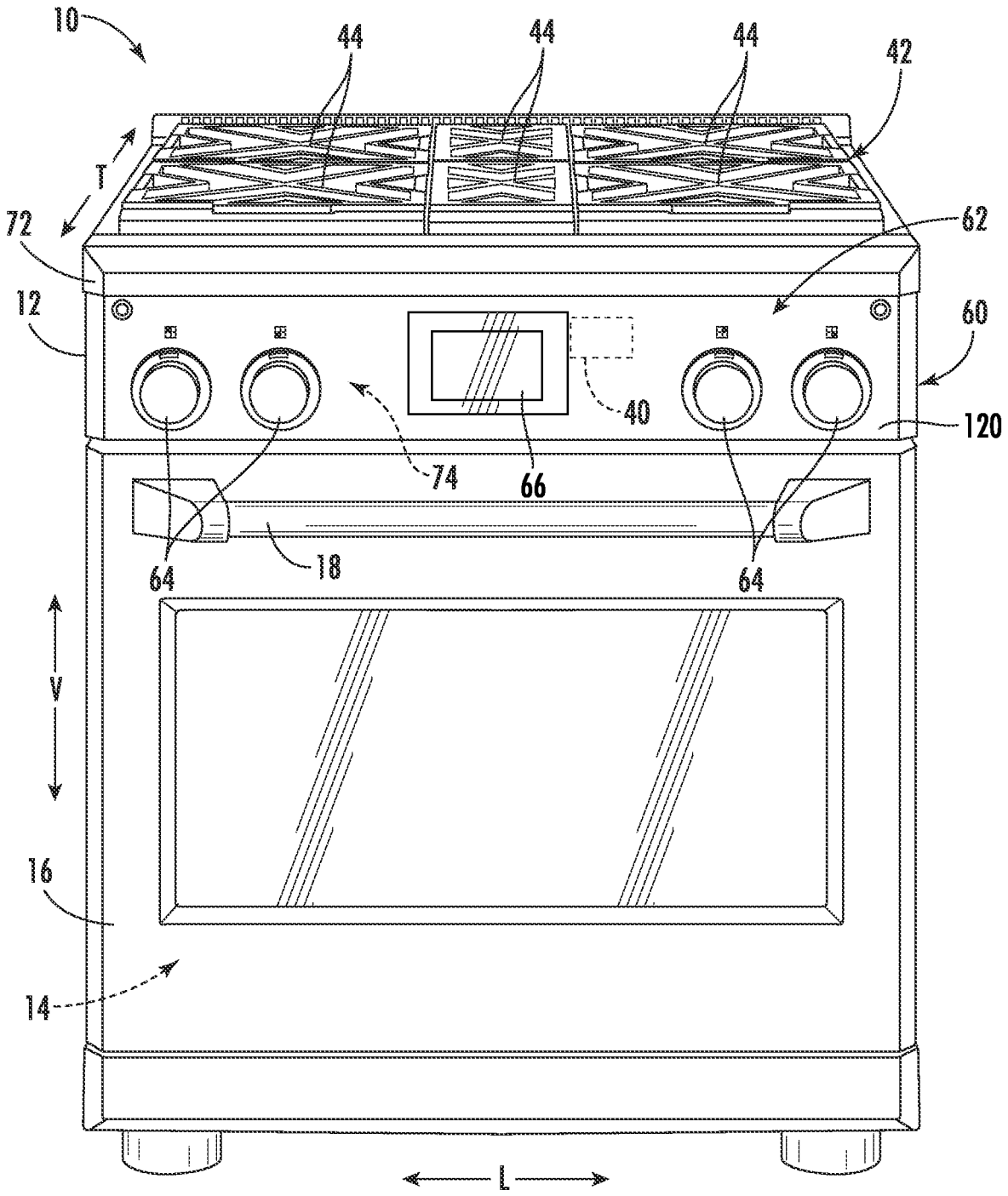
FIG. 1 provides a perspective view of a cooking appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

Figure 2:
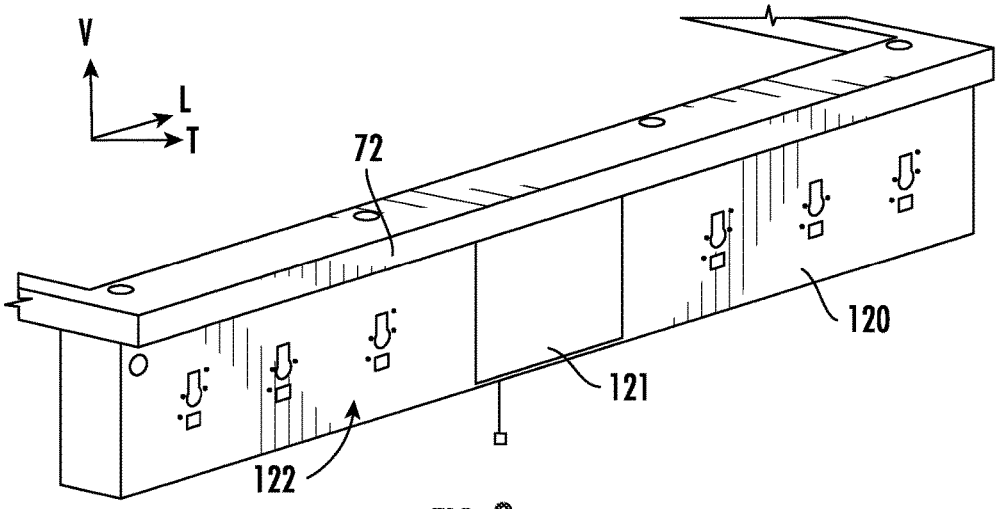
FIG. 2 provides a perspective view of a front panel and bullnose of the cooking appliance of FIG. 1.

Turning now to the figures, FIG. 1 provides a perspective view of a cooking appliance, such as a cooking appliance 10, according to exemplary embodiments of the present disclosure. FIG. 2 provides a magnified perspective view of a portion of a control panel of cooking appliance 10. Generally, cooking appliance 10 defines a vertical direction V, a lateral direction L, and a transverse direction T. The vertical direction V, lateral direction L, and transverse direction T are mutually perpendicular and form an orthogonal direction system. As will be understood, cooking appliance 10 is provided by way of example only, and the present subject matter may be used in any suitable appliance. Thus, the present disclosure may be used with other oven, range, or cooktop appliance configurations (e.g., configurations that define multiple interior cavities for the receipt of food, include no interior cavities, or are otherwise different than the configuration shown in FIG. 1), as well as other suitable appliances, as would be understood in light of the present disclosure.

Cooking appliance 10 includes an insulated cabinet 12 with an interior cooking chamber 14 defined by an interior surface of cabinet 12. Cooking chamber 14 is configured for the receipt of one or more food items to be cooked. Cooking appliance 10 includes a door 16 rotatably mounted to cabinet 12 (e.g., with a hinge—not shown). A handle 18 may be mounted to door 16 and may assist a user with opening and closing door 16 in order to access an opening to cooking chamber 14. For example, a user can pull on handle 18 to open or close door 16 and access cooking chamber 14 through the opening. As would be understood, one or more internal heating elements (e.g., baking or broiling heating elements) may be provided within cooking chamber 14 to cook or otherwise heat items therein.

Cooking appliance 10 can include a seal (not shown) between door 16 and cabinet 12 that assist with maintaining heat and cooking fumes within cooking chamber 14 when door 16 is closed, as shown in FIG. 1. One or more parallel glass panes 22 provide for viewing the contents of cooking chamber 14 when door 16 is closed and assist with insulating cooking chamber 14. Optionally, a baking rack (not pictured) is positioned in cooking chamber 14 for the receipt of food items or utensils containing food items.

In some embodiments, cooking appliance 10 includes a cooktop surface 42 having one or more heating elements 44 for use in heating or cooking operations. In exemplary embodiments, cooktop surface 42 is comprised of metal (e.g., steel) panel on which one or more grates may be supported. In other embodiments, however, cooktop surface 42 may be comprised of another suitable material, such as a ceramic glass or another suitable non-metallic material. Heating elements 44 may be various sizes, as shown in FIG. 1, and may employ any suitable method for heating or cooking an object, such as a cooking utensil (not shown), and its contents. In one embodiment, for example, heating element uses a heat transfer method, such as electric coils or gas burners, to heat the cooking utensil. In another embodiment, however, heating element 44 uses an induction heating method to heat the cooking utensil directly. In turn, heating element may include a burner element, electric heat element, induction element, or another suitable heating element.

Some embodiments of cooking appliance 10 include a controller 40 (e.g., configured to control one or more operations of cooking appliance 10). For example, controller 40 may control at least one operation of cooking appliance 10 that includes an internal heating element or cooktop heating element 44. Controller 40 may be in communication (via for example a suitable wired or wireless connection) with one or more of heating element(s) 44 and other suitable components of cooking appliance 10, as discussed herein. In general, controller 40 may be operable to configure cooking appliance 10 (and various components thereof) for cooking. Such configuration may be based, for instance, on a plurality of cooking factors of a selected operating cycle or mode.

By way of example, controller 40 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 40 may be positioned in a variety of locations throughout cooking appliance 10. As illustrated, controller 40 may be located within a user interface 62 of cooking appliance 10. In some such embodiments, input/output ("I/O") signals may be routed between controller 40 and various operational components of cooking appliance 10, such as heating element(s) 44, control knobs 64, a display 66, sensors, alarms, or other components as may be provided. For instance, signals may be directed along one or more wiring harnesses that may be routed through cabinet 12. In some embodiments, controller 40 is in communication with user interface assembly 62 and control knobs 64 through which a user may select various operational features and modes and monitor progress of cooking appliance 10. In one embodiment, user interface assembly 62 may represent a general purpose I/O ("GPIO") device or functional block. In one embodiment, user interface assembly 62 may include input components, such as one or more of a variety of electrical, mechanical, or electro-mechanical input devices including rotary dials, push buttons, and touch pads. User interface assembly 62 may include display 66, which may be a digital or analog display configured to provide operational feedback to a user.

During use of cooking appliance 10, the amount of heat delivered by each heating element 44 on cooktop 42 may be controlled by controller 40 and a corresponding knob assembly 60, described in detail below. For instance, knob assembly 60 may include one or more control knobs 64 mounted (e.g., rotatably) on a front panel 120 of user interface 62 forward from heating elements 44 (e.g., along or relative to the transverse direction T). Each control knob 64 may correspond to a discrete heating element 44. Control knob 64, as used herein, refers to any configuration of dial, and not just one having a circular base shape. For example, the present disclosure contemplates exemplary embodiments wherein control knobs 64 have a rectangular base shape, an ovular base shape, or any other shape having one or more curved lines, straight lines, or both.

Front panel 120 may have an opening 121 defined therein. Opening 121 may be formed as a through hole along the transverse direction T through front panel 120. For instance, front panel 120 may define a front face 122 facing predominantly forward along the transverse direction T. In some embodiments, opening 121 is located at or near a center of front panel 120 along the lateral direction L. For example, opening 121 is provided between a first set of control knobs 64 and a second set of control knobs 64 along the lateral direction L. Opening 121 may be predominantly quadrilateral in shape. However, this shape is merely exemplary, and opening 121 may have any suitable shape.

Cooking appliance 10 may include a bullnose (or trim portion) 72. Bullnose 72 may extend forward along the transverse direction T above front panel 120. In some embodiments, bullnose 72 may be part of cooktop 42. Bullnose 72 may extend past front face 122 of front panel 120 along the transverse direction T. In detail, bullnose 72 may extend about 0.5" to about 1" past front face 122 of front panel 120 along the transverse direction T. Additionally or alternatively, bullnose 72 may extend the width of cooking appliance 10 in the lateral direction L. Bullnose 72 may have a hollow interior, as will be explained in more detail below.

Figure 6:
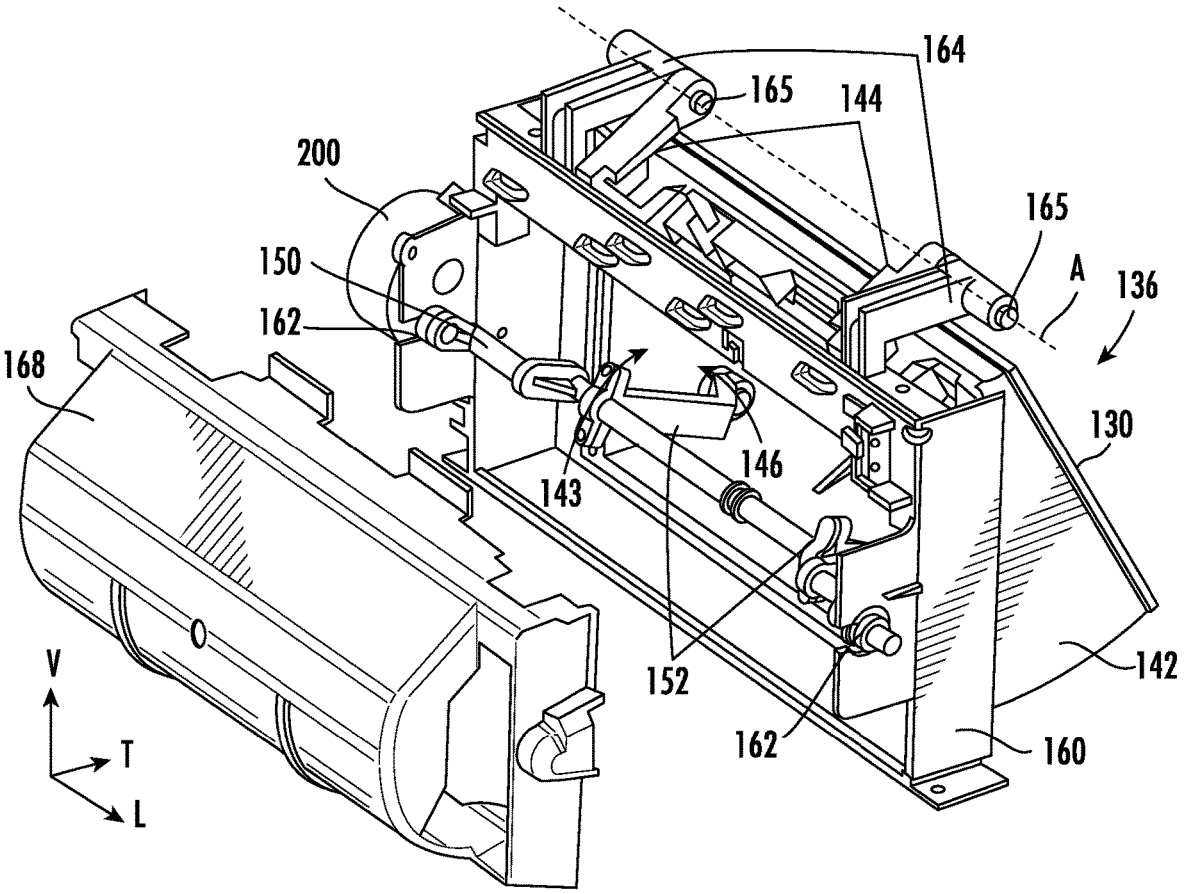
FIG. 6 provides a rear perspective view of the articulating display assembly of FIG. 3 with a rear cover removed.
Figure 7:
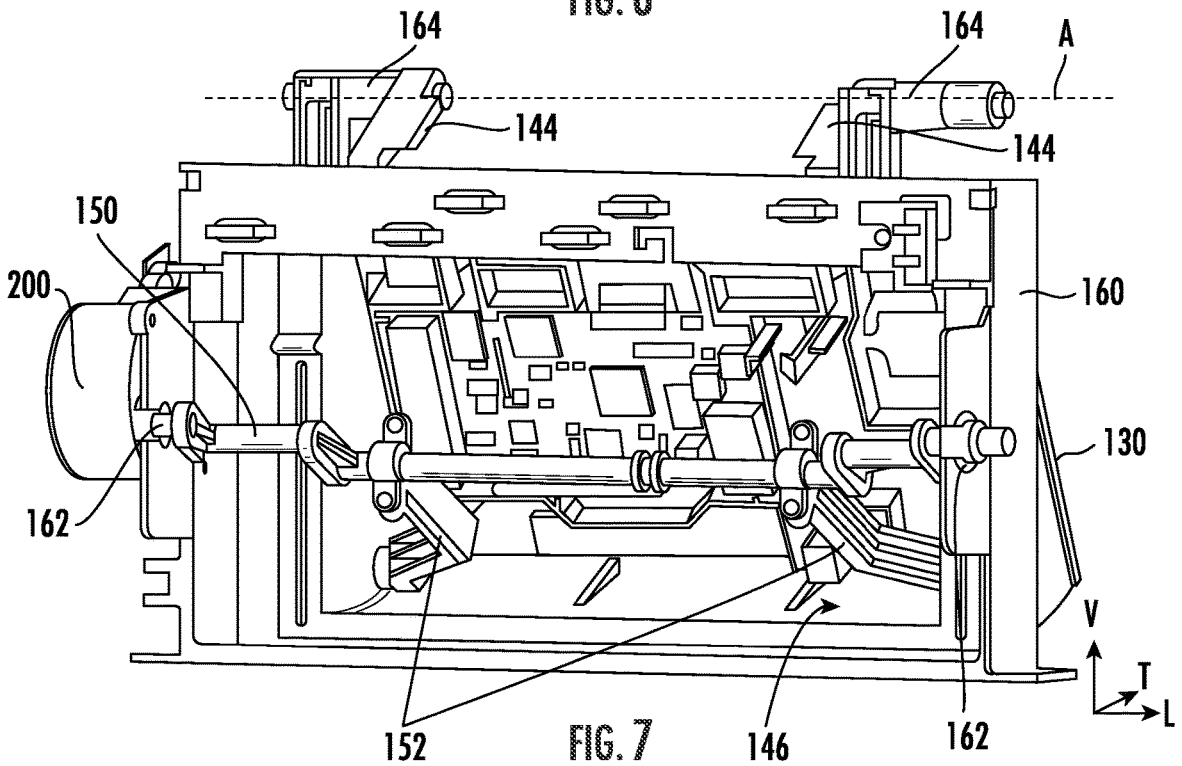
FIG. 7 provides a rear view of the articulating display assembly of FIG. 3 with a rear cover removed.

An articulating display assembly 136 may be mounted to front panel 120. For example, articulating display assembly 136 may be fixed so as to be displayed through opening 121. Articulating display assembly 136 may include a fixed frame 160, a rotatable support mechanism 140, and a user interface panel 130. Fixed frame 160 may be attached to front panel 120 and provided adjacent to opening 121. In detail, as best seen in FIG. 6, fixed frame 160 may have a shape complimentary to opening 121. Fixed frame 160 may thus provide a mount for attaching rotatable support mechanism 140. Fixed frame 160 may be made of any suitable material, such as a plastic, a metal, a composite, or the like. Fixed frame 160 may include a crank bearing 162. In some embodiments, fixed frame 160 includes two crank bearings 162. Crank bearings 162 may be spaced apart along the lateral direction L. Crank bearing 162 may be formed from a tab extending from fixed frame 160 in a rearward direction along the transverse direction T. Crank bearing 162 may be located at or near a center of a side rail of fixed frame 160 along the vertical direction. Crank bearing 162 may be shaped so as to support a crankshaft (described in more detail below).

Fixed frame 160 may include one or more axis arms 164. Axis arms 164 may extend in the forward direction along the transverse direction T from a top of fixed frame 160. Axis arms 164 may be located within bullnose 72. For instance, axis arms 164 may extend along the transverse direction T within bullnose 72 (e.g., toward a front portion of bullnose 72). Axis arms 164 may collectively define a pivot axis A along the lateral direction L. For example, a pivot shaft 165 may extend from a distal end of each axis arm 164 along the lateral direction. Accordingly, pivot axis A may be positioned within bullnose 72. In some embodiments, a single pivot shaft 165 may connect the axis arms 164 together. It should be noted that pivot axis A may be defined along any suitable direction according to specific embodiments.

Figure 3:
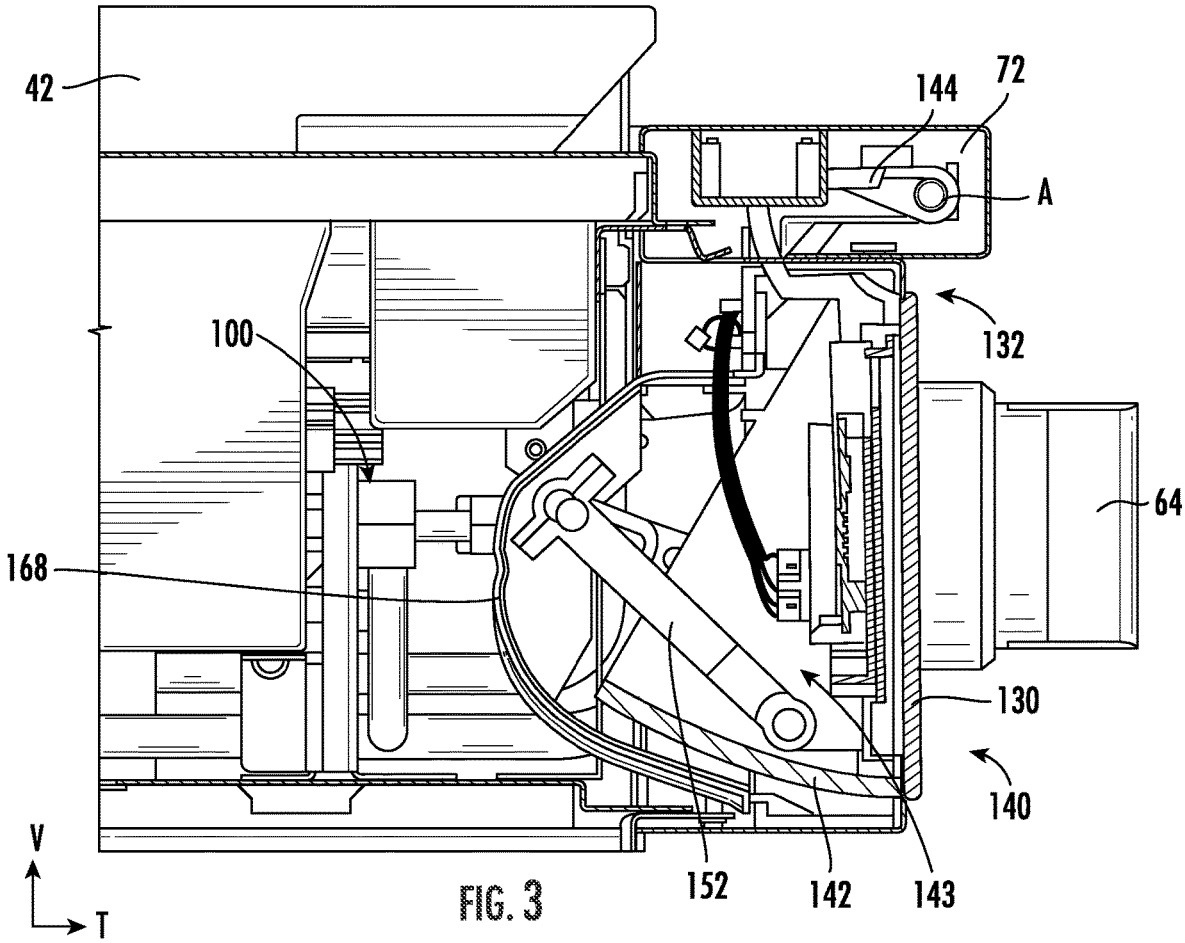
FIG. 3 provides a side cut-away view of an articulating display assembly according to exemplary embodiments of the present disclosure.

The rotatable support mechanism 140 may be rotatably attached to fixed frame 160. Rotatable support mechanism 140 may include a rotating frame 142. Rotating frame 142 may be configured to pivot with respect to fixed frame 160 (e.g., about pivot axis A). Rotating frame 142 may have a pie-shaped cross section taken along the vertical V and transverse directions T (e.g., as seen in FIG. 3). Accordingly, rotating frame 142 may form a cavity 143 in which various parts may be located (e.g., electronics, stiffeners, connectors, etc.). Moreover, rotating frame 140 may be positioned to fit within opening 121 in front panel 120. In detail, rotating frame 142 may be positioned proximate opening 121 so as to be accessible through opening 121. Rotating frame 142 may be rotatable between a first position (e.g., FIG. 3 and FIG. 5) and a second position (e.g., FIG. 4 and FIG. 6).

Rotating frame 142 may include a pair of pivot arms 144. The pair of pivot arms 144 may rotatably attach rotating frame 142 to fixed frame 160. The pair of pivot arms 144 may mirror each other along the lateral direction L, and as such, for the sake of brevity, a single pivot arm 144 will be described herein. Pivot arm 144 may be provided at or near a top of rotating frame 142. In detail, pivot arm 144 may include a first portion 1441, a second portion 1442, and a third portion 1443. First portion 1441 of pivot arm 144 may protrude from the top of rotating frame 142 along the transverse direction T (e.g., when rotating frame 142 is in the first position). For instance, first portion 1441 may protrude rearward (e.g., towards a center of cooking appliance 10) from rotating frame 142. A protrusion length of first portion 1441 may vary according to specific embodiments.

Figure 4:
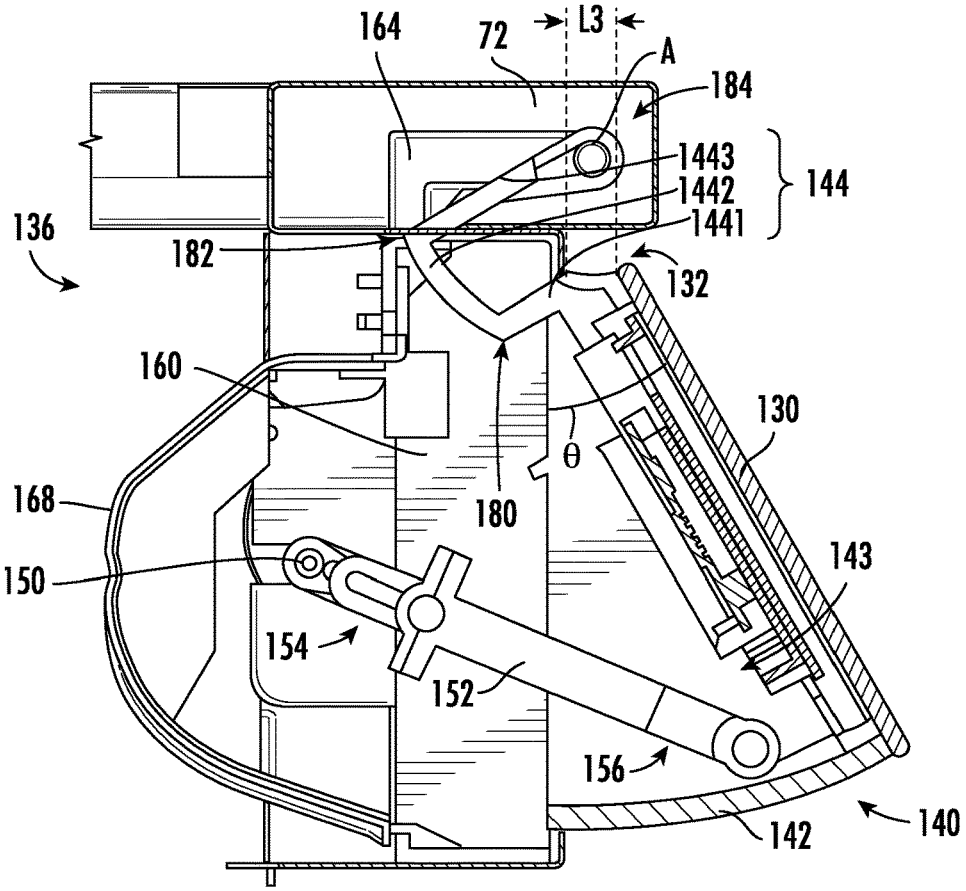
FIG. 4 provides a side cut-away view of the articulating display assembly of FIG. 3 in an open position.

Second portion 1442 of pivot arm 144 may protrude substantially along the vertical direction V from a distal end 180 of first portion 1441 (e.g., when rotating frame 142 is in the first position). In some embodiments (e.g., as shown in FIG. 4), second portion 1442 is curved, having a concave portion facing toward front face 122 of front panel 120. A protrusion length of second portion 1442 may vary according to specific embodiments, however the protrusion length of second portion 1442 may generally be longer than the protrusion length of first portion 1441.

Third portion 1443 of pivot arm 144 may protrude substantially along the transverse direction T from a distal end 182 of second portion 1442 (e.g., when rotating frame 142 is in the first position). Third portion 1443 may protrude in the forward direction (e.g., away from the center of cooking appliance 10). Thus, third portion 1443 may be substantially parallel with first portion 1441. Additionally or alternatively, pivot arm 144 may have a "U" shape. A protrusion length of third portion 1443 may vary according to specific embodiments, however the protrusion length of third portion 1443 may generally be longer than the protrusion length of each of first portion 1441 and second portion 1442.

A distal end 184 of third portion 1443 may be located within bullnose 72. In detail, the distal end 184 of third portion 1443 may extend toward a front portion of bullnose 72. Accordingly, the distal end 184 of third portion 1443 may be located above and in front of front panel 120 when rotating frame 142 is in the first position. As used herein, "in front of" means the distal end 184 is positioned along the transverse direction so as to be between front panel 120 and the user when in the first position. The distal end of third portion 1443 may include a connecting means for attaching pivot arm 144 to axis arm 164. For one example, the distal end of third portion 1443 includes a through hole through which pivot shaft 165 is inserted. In an alternate embodiment, the distal end of third portion 1443 includes pivot shaft 165 while the distal end of axis arm includes a through hole through which pivot shaft 165 is inserted. It should be acknowledged that any suitable pivoting connecting means may be incorporated, such as fasteners, pins, dual shafts, and the like, and that the disclosure is not limited to those listed herein. Thus, pivot arm 144 may be pivotally connected to axis arm 164 at the pivot axis A. As described above, pivot axis A may be defined along the lateral direction L and may be located within bullnose 72.

Rotatable support mechanism 140 may include the user interface panel 130. User interface panel 130 may include display 66 and user interface 62. User interface panel 130 may be attached to a front face of rotating frame 142 (e.g., facing forward along the transverse direction T). For instance, when rotating frame 142 is in the first position, user interface panel 130 may be parallel to front panel 120 (i.e., user interface panel 130 may extend along the vertical direction V and the lateral direction T). User interface panel 130 may include interactive features by which a user may control cooking appliance 10. For example, user interface panel 130 may be a touch screen. However, user interface panel 130 may also be a control board with buttons, knobs, switches, or the like. Indeed, user interface panel 130 may simply be a screen [e.g., a Liquid Crystal Display (LCD) screen].

As described above, rotating frame 142 (and user interface panel 130) may be rotatable between the first position and the second position. Advantageously, user interface panel 130 may be rotated into a more ergonomically friendly position for a user of cooking appliance 10. Accordingly, rotatable support mechanism 140 may include a motor 200. Motor 200 may be any suitable motor capable of producing a rotational output, such as a stepper motor, an AC motor, a DC motor, or the like. Motor 200 may be located laterally adjacent to one of the crank bearings 162 of fixed frame 160. For instance, motor 200 may be placed laterally outside of fixed frame 160 (e.g., outside of a boundary set by opening 121). Further, motor 200 may be provided behind front panel 120. A thickness of motor 200 along the lateral direction L may be between about 1" and about 3". Accordingly, motor 200 may occupy limited space behind front panel 120, allowing more room for additional heating components (such as heating components 100 shown in FIG. 3).

Motor 200 may transmit a rotational force to a crankshaft 150. Crankshaft 150 may be supported by crank bearings 162 (e.g., at either lateral side of fixed frame 160). Accordingly, as motor 200 rotates, crankshaft 150 may revolve about the motor axis of rotation. Rotatable support mechanism 140 may further include at least one linking arm 152. Linking arm 152 may be pivotally connected to crankshaft 150 and rotating frame 142. In detail, a first end 154 of linking arm 152 may be rotatably connected to crankshaft 150, while a second end 156 of linking arm 152 is rotatably connected to an inner surface 146 of rotating frame 142 (e.g., within cavity 143). The second end 156 of linking arm 152 may be connected at any suitable location within cavity 143. For example, as shown in FIG. 4, the second end 156 of linking arm 152 may be connected at or near a bottom of rotating frame 142 and adjacent to user interface panel 130. However, the position and connection of linking arm 152 is not limited.

Figure 5:
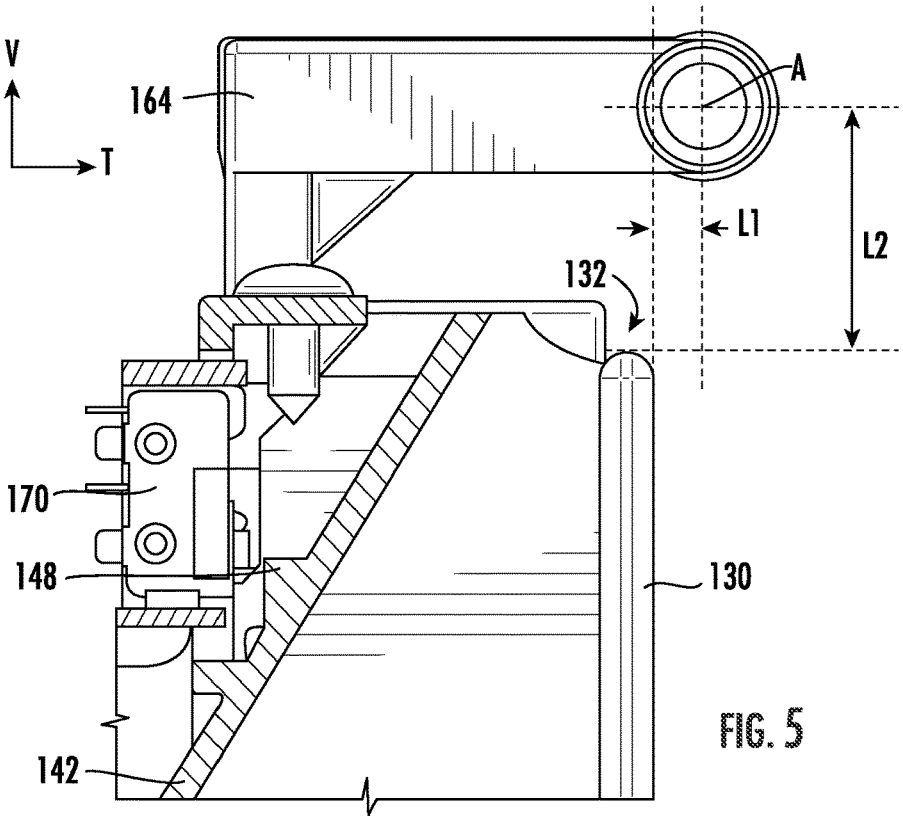
FIG. 5 provides a close-up view of a pivot point of the articulating display assembly of FIG. 3.

Referring briefly to FIG. 5, rotatable support mechanism 140 may include an activation switch 170. Activation switch 170 may be mounted to fixed frame 160. Activation switch 170 may be mounted such that rotating frame 142 contacts activation switch 170 when rotating frame 142 reaches the first position from the second position. Activation switch 170 may alert motor 200 (e.g., via controller 40) that a rotation of rotating frame 142 has completed and the rotating frame 142 is in the first position. For instance, rotating frame 142 may include a protrusion 148 configured to contact activation switch 170. Accordingly, when motor 200 rotates rotatable frame 142 from the second position to the first position, protrusion 148 contacts activation switch 170. Controller 40 may then stop an operation of motor 200 to avoid damage to rotatable frame 142, fixed frame 160, motor 200, and/or user interface panel 130.

As discussed above, FIG. 3 illustrates rotatable support mechanism 140 (and user interface panel 130) in the first position, while FIG. 4 illustrates rotatable support mechanism 140 (and user interface panel 130) in the second position. As shown, the second position may position user interface panel 130 at a predetermined acute angle θ with respect to front panel 120. The predetermined acute angle θ may be between 25° and 35°. In some embodiments, the predetermined acute angle is 30°. Accordingly, in some embodiments, user interface panel 130 may be angled upward in the vertical direction V, providing a more natural viewing and operating position for a user. In alternate embodiments, rotatable frame 142 and fixed frame 160 may be inverted 180° such that user interface panel 130 is angled downward in the vertical direction V.

In addition to providing a rotational movement of user interface panel, rotatable support mechanism 140 may provide a translational movement of user interface panel. In detail, as described above, a location of pivot axis A within bullnose 72 may be above and in front of user interface panel 130 in the transverse direction T, when rotating frame 142 is in the first position. For instance, a center of pivot axis A may be located a predetermined distance L1 in front of a front surface of user interface panel 130 (e.g., when the rotatable frame is in the first position). The predetermined distance L1 is between about 0.1" and about 0.3 inches. In some embodiments, the center of pivot axis A is located about 0.2" in front of the front surface of user interface panel 130. Additionally or alternatively, pivot axis A may be located a predetermined distance L2 above a top edge 132 of user interface panel 130. The predetermined distance L2 may be between about 0.8" and about 1.5". In some embodiments, the predetermined distance L2 is about 1".

Due to the shape of pivot arm 144, user interface panel 130 may swing away from front panel 120. In detail, as rotatable frame 142 moves from the first position to the second position, a top edge 132 of user interface panel 130 may translate a predetermined distance L3 away from front face 122 of front panel 120 along the transverse direction T. The predetermined distance L3 may be between about 0.3" and about 1". In some embodiments, the predetermined distance L3 is about 0.5". Advantageously, top edge 132 of user interface panel 130 may be more visible to users.

Articulating display assembly 136 may include a rear cover 168. Rear cover may be attached to a rear portion of fixed frame 160 (e.g., toward the center of cooking appliance 10). Rear cover 168 may be formed so as to protect rotatable support mechanism 140. For instance, rear cover 168 may be shaped to allow crankshaft 150 to complete rotation within rear cover 168 unimpeded. Rear cover 168 may be removably coupled to fixed frame 160, for instance, with fasteners such as screws, bolts, snaps, adhesives, or the like. Additionally or alternatively, rear cover 168 may include an insulation layer. Accordingly, rear cover may protect the components contained within rotatable support mechanism 140 while taking up minimal space behind front panel 120.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance extending along a lateral direction between a pair of opposing sides, extending along a transverse direction between a front and a back, and extending along a vertical direction between a top and a bottom, the cooking appliance comprising:

a front panel supported by the cooking appliance, the front panel defining an opening;

a user interface panel rotatably positioned at the opening, the user interface panel being rotatable between a first position and a second position; and a rotatable support mechanism that carries the user interface panel between the first position and the second position, the rotatable support mechanism positioned proximate to the opening and having an axis of rotation that is spaced apart from the opening and located above and in front of the user interface panel when in the first position, wherein the rotatable support mechanism comprises a pair of pivot arms, each of the pair of pivot arms comprising:

a first portion protruding from a top of the rotatable support mechanism rearward along the transverse direction when the user interface panel is in the first position, the first portion being substantially perpendicular to the user interface panel;

a second portion protruding from a distal end of the first portion along the vertical direction when the user interface panel is in the first position, wherein the first portion is disposed between the second portion and the user interface panel; and a third portion protruding from a distal end of the second portion forward along the transverse direction when the user interface panel is in the first position, wherein a distal end of the third portion is provided at the axis of rotation.

2. The cooking appliance of claim 1, further comprising a motor positioned adjacent to the user interface panel along the lateral direction when in the first position, the motor configured for selectively moving the user interface panel between the first position and the second position.

3. The cooking appliance of claim 2, further comprising:

a crankshaft connected with the motor and being rotatable by the motor; and at least one linking arm connecting the crankshaft with the rotatable support mechanism.

4. The cooking appliance of claim 1, wherein when the user interface panel is in the first position, the user interface panel is parallel to a front face of the front panel, and when the user interface panel is in the second position, the user interface panel is positioned at a predetermined acute angle with respect to the front face of the front panel.

5. The cooking appliance of claim 4, wherein the predetermined acute angle is between 25° and 35°.

6. The cooking appliance of claim 5, wherein the predetermined acute angle is 30°.

7. The cooking appliance of claim 4, wherein when the user interface panel is in the second position, a top edge of the user interface panel is located a predetermined distance in front of the front face along the transverse direction.

8. The cooking appliance of claim 7, wherein the predetermined distance is between 0.5 inches and 0.7 inches.

9. The cooking appliance of claim 1, further comprising a fixed frame attached to the front panel, wherein the rotatable support mechanism rotates with respect to the fixed frame.

10. The cooking appliance of claim 9, further comprising:

a motor positioned adjacent to the user interface panel along the lateral direction when in the first position, the motor configured for selectively moving the user interface panel between the first position and the second position;

an activation switch provided on the fixed frame; and a controller configured to control the motor at least partially based on a signal from the activation switch, wherein the controller stops the motor when the rotatable support mechanism contacts the activation switch.

11. The cooking appliance of claim 1, wherein the axis of rotation is between 0.1 inches and 0.3 inches in front of a front surface of the user interface panel along the transverse direction.

12. The cooking appliance of claim 1, further comprising a bullnose provided above the front panel and extending forward of the front panel in the transverse direction.

13. The cooking appliance of claim 12, wherein the axis of rotation of the rotatable support mechanism is located within the bullnose.

14. An articulating display assembly defining a vertical direction, a lateral direction, and a transverse direction, the articulating display assembly comprising:

a frame defining an opening along the transverse direction;

a support housing rotatably connected to the frame, the support housing being rotatable between a closed position and an open position; and a user interface panel attached to the support housing, wherein the support housing is positioned proximate to the opening and having an axis of rotation that is spaced apart from the opening and located above and in front of the user interface panel when the support housing is in the closed position, wherein the rotatable support mechanism comprises a pair of pivot arms, each of the pair of pivot arms comprising:

a first portion protruding from a top of the rotatable support mechanism rearward along the transverse direction when the user interface panel is in the closed position, the first portion being substantially perpendicular to the user interface panel;

a second portion protruding from a distal end of the first portion along the vertical direction when the user interface panel is in the closed position, wherein at least part of the second portion is provided above the display panel along the vertical direction; and a third portion protruding from a distal end of the second portion forward along the transverse direction when the user interface panel is in the first position, wherein a distal end of the third portion is provided at the axis of rotation.

15. The articulating display assembly of claim 14, further comprising a motor positioned adjacent to the user interface panel along the lateral direction when the support housing is in the closed position, the motor configured for selectively moving the support housing between the closed position and the open position.

16. The articulating display assembly of claim 15, further comprising:

a crankshaft connected with the motor and being rotatable by the motor; and at least one linking arm connecting the crankshaft with the support housing.

17. The articulating display assembly of claim 14, wherein when the support housing is in the open position, a top edge of the user interface panel is located a predetermined distance in front of the frame along the transverse direction.

18. The articulating display assembly of claim 14, wherein the axis of rotation is between 0.1 inches and 0.3 inches in front of a front surface of the user interface panel along the transverse direction.

* * * * *